US008591203B2

(12) United States Patent
Yoshihara et al.

(10) Patent No.: US 8,591,203 B2
(45) Date of Patent: Nov. 26, 2013

(54) PUMP APPARATUS

(75) Inventors: Yoshihito Yoshihara, Kashihara (JP); Yoshiaki Hamasaki, Kashiba (JP); Takashi Taniwa, Kashihara (JP); Katsutake Asano, Kashiwara (JP)

(73) Assignee: JTEKT Corporation, Osaka (JP)

( * ) Notice: Subject to any disclaimer, the term of this patent is extended or adjusted under 35 U.S.C. 154(b) by 552 days.

(21) Appl. No.: 11/140,738

(22) Filed: Jun. 1, 2005

(65) Prior Publication Data

US 2005/0271533 A1 Dec. 8, 2005

(30) Foreign Application Priority Data

Jun. 2, 2004 (JP) ..... 2004-164502

(51) Int. Cl.
*F04B 35/04* (2006.01)

(52) U.S. Cl.
USPC ..... 417/423.14

(58) Field of Classification Search
USPC ..... 401/243; 60/535, 592; 285/240, 148.14, 285/139.3, 60, 345, 347, 110; 417/540, 417/312, 423.11, 423.14; 29/525, 453, 516; 277/607, 609, 630, 616, 576, 572
See application file for complete search history.

(56) References Cited

U.S. PATENT DOCUMENTS 2,152,056 A * 3/1939 Kenney et al. ..... 417/372
3,065,711 A * 11/1962 Grad ..... 91/505
3,508,766 A * 4/1970 Berg et al. ..... 285/21.1
3,990,730 A * 11/1976 Ekman ..... 285/110
4,103,937 A * 8/1978 Wakefield ..... 285/110
4,182,519 A * 1/1980 Wilson ..... 277/616
4,239,461 A * 12/1980 Elson ..... 417/312
4,260,182 A * 4/1981 Bruner ..... 285/23
4,621,841 A * 11/1986 Wakefield ..... 285/139.2
4,969,804 A * 11/1990 Gannaway ..... 417/360
5,007,807 A * 4/1991 Gannaway ..... 417/363
5,056,801 A * 10/1991 Beadle ..... 277/577
5,101,931 A * 4/1992 Blass et al. ..... 181/240
5,133,647 A * 7/1992 Herron et al. ..... 417/312
5,205,719 A * 4/1993 Childs et al. ..... 417/312
5,261,487 A * 11/1993 McLeod et al. ..... 166/85.3
5,499,908 A * 3/1996 Schmitz, III ..... 417/368
5,516,157 A * 5/1996 Williamson ..... 285/212

(Continued)

FOREIGN PATENT DOCUMENTS

EP 0905378 A1 3/1999
GB 831949 4/1960
JP 11-166483 A 6/1999

*Primary Examiner* — Devon Kramer
*Assistant Examiner* — Amene Bayou
(74) *Attorney, Agent, or Firm* — Birch, Stewart, Kolasch & Birch, LLP

(57) ABSTRACT

In a pump apparatus having a reduction chamber for reducing pulsation of a hydraulic fluid pressurized in a pump section on the way of a discharge channel having an opening in the outer surface of the housing of the pump section, a remaining fluid inflow prevention pipe having one end fitted into and fixed to the discharge channel between the outer surface and the reduction chamber and the other end positioned in the reduction chamber is provided, and a seal lip for fluid-tightly sealing the space between the inner wall of the discharge channel and the one end is provided on the outer circumference of the one end. The seal lip is formed in a shape tapered toward the discharge side. Further, the outside diameter of the other end of the remaining fluid inflow prevention pipe is made larger than the inside diameter of the discharge channel.

6 Claims, 7 Drawing Sheets

(56) References Cited

U.S. PATENT DOCUMENTS

| | | | | | |
|---|---|---|---|---|---|
| 5,535,724 | A * | 7/1996 | Davis | 123/467 |
| 5,551,732 | A * | 9/1996 | Bartholomew | 285/93 |
| 5,797,376 | A * | 8/1998 | Frank et al. | 123/509 |
| 5,800,146 | A * | 9/1998 | Junemann et al. | 417/68 |
| 5,851,036 | A * | 12/1998 | Vanesky | 285/294.1 |
| 5,853,204 | A * | 12/1998 | Bartholomew | 285/305 |
| 6,193,238 | B1 * | 2/2001 | Sporre | 277/609 |
| 6,322,329 | B1 * | 11/2001 | Vera | 417/313 |
| 6,439,620 | B1 * | 8/2002 | Guest | 285/347 |
| 6,506,029 | B1 * | 1/2003 | Reichenmiller | 417/313 |
| 6,745,565 | B1 * | 6/2004 | Wahner et al. | 60/487 |
| 7,435,062 | B2 * | 10/2008 | Tadano et al. | 417/410.3 |
| 2005/0106037 | A1 * | 5/2005 | Kim et al. | 417/312 |

* cited by examiner

PUMP APPARATUS

CROSS-REFERENCE TO RELATED APPLICATION

This non-provisional application claims priority under 35 U.S.C. §119(a) on Patent Application No. 2004-164502 filed in Japan on Jun. 2, 2004, the entire contents of which are hereby incorporated by reference.

BACKGROUND OF THE INVENTION

1. Field of the Invention

The present invention relates to a pump apparatus comprising, on the way of a discharge channel having an opening in the outer surface of the housing of a pump section, a reduction chamber for reducing pulsation of a hydraulic fluid pressurized by the pump section.

2. Description of Related Art

Recent automobiles are equipped with many assistant apparatuses such as a power steering apparatus and an automatic transmission apparatus, which are activated by oil pressure to assist driving operations, and a pump apparatus is installed to generate hydraulic oil pressure of such an assistant apparatus. Since the pump apparatus is installed in vehicles, it is required to be small in size and generate high oil pressure, and therefore a rotary positive displacement pump, such as a vane pump and a gear pump, is often used as a pump section for pressurizing the hydraulic oil.

In such a pump apparatus, the hydraulic oil is intermittently discharged from the pump section, and pulsation occurs in the discharged hydraulic oil. Hence, a reduction chamber for reducing the pulsation needs to be provided on the discharge side. When the reduction chamber and the pump apparatus are provided separately, the installation performance in a vehicle is poor, and therefore it is required to integrate the reduction chamber and the pump apparatus to achieve a compact structure.

As a pump apparatus capable of satisfying such a requirement for the compact structure, there is a pump apparatus that has a reduction chamber for reducing pulsation of hydraulic oil pressurized in the pump section on the way of a discharge channel having an opening in the outer surface of the housing of the pump section and is constructed to discharge the hydraulic oil whose pulsation has been reduced in the reduction chamber from the opening in the outer surface of the housing (see, for example, Japanese Patent Application Laid-Open No. 11-166483 (1999)).

In general, a pump apparatus installed in a vehicle is shipped after performing a performance inspection after assembly and removing the hydraulic oil used for the performance inspection. When shipping the pump apparatus, a dustproof cap is attached to the opening in the outer surface of the housing so as to prevent infiltration of foreign matters such as dust during the transport to a shipping destination.

However, in the pump apparatus having the reduction chamber on the way of the discharge channel as disclosed in the Japanese Patent Application Laid-Open No. 11-166483 (1999), since the configuration of the path from the pump section to the opening in the outer surface of the housing is complicated, it is difficult to perfectly remove the hydraulic oil used for the performance inspection, and consequently the pump apparatus is sometimes shipped with the hydraulic oil remaining in the reduction chamber. In this case, there was the problem that the hydraulic oil remaining in the reduction chamber flowed into the discharge channel on the opening side during the transport to the shipping destination, and the hydraulic oil flowed into the discharge channel on the opening side leaked out of the opening when a worker at the shipping destination detached the dustproof cap to install the pump apparatus in a vehicle. When such leakage of hydraulic oil occurs, various problems may be caused, for example, the periphery is soiled with the leaked hydraulic oil, and the leaked hydraulic oil drops on the floor and makes the floor slippery for the worker.

Such problems are not associated only with pump apparatuses using oil as a hydraulic fluid, and may also be caused by pump apparatuses using a liquid other than oil as a hydraulic fluid.

BRIEF SUMMARY OF THE INVENTION

The present invention has been made with the aim of solving the above problems, and it is an object of the present invention to provide a pump apparatus comprising a member for preventing the inflow of a hydraulic fluid remaining in a reduction chamber into a discharge channel on the opening side, and thereby avoiding leakage of the hydraulic fluid during installation at a shipping destination and preventing various problems associated with the leakage.

A pump apparatus according to a first aspect of the present invention is a pump apparatus comprising, on the way of a discharge channel having an opening in the outer surface of a housing of a pump section, a reduction chamber for reducing pulsation of a hydraulic fluid pressurized in the pump section, and characterized by comprising a remaining fluid inflow prevention pipe having one end fitted into and fixed to the discharge channel between the outer surface and the reduction chamber, and other end positioned in the reduction chamber, wherein a seal lip for fluid-tightly sealing the space between the inner wall of the discharge channel and the one end is provided on the outer circumference of the one end.

A pump apparatus according to a second aspect of the present invention is based on the first aspect, and characterized in that the seal lip is formed in a shape tapered toward the discharge side.

A pump apparatus according to a third aspect of the present invention is a pump apparatus comprising, on the way of a discharge channel having an opening in the outer surface of a housing of a pump section, a reduction chamber for reducing pulsation of a hydraulic fluid pressurized in the pump section, and characterized by comprising: a remaining fluid inflow prevention pipe having one end fitted into and fixed to the discharge channel between the outer surface and the reduction chamber, and other end positioned in the reduction chamber; and a seal part for fluid-tightly sealing the space between the inner wall of the discharge channel and the one end.

A pump apparatus according to a fourth aspect of the present invention is based on any one of the first through third aspects, and characterized in that the outside diameter of the other end of the remaining fluid inflow prevention pipe is made larger than the inside diameter of the discharge channel between the outer surface and the reduction chamber.

According to the first aspect, the pump apparatus comprises the remaining fluid inflow prevention pipe having one end fitted into and fixed to the discharge channel between the outer surface of the housing and the reduction chamber, and the other end positioned in the reduction chamber, and a seal lip for fluid-tightly sealing the space between the inner wall of the discharge channel and the one end of the remaining fluid inflow prevention pipe is provided on the outer circumference of the one end of the remaining fluid inflow prevention pipe. Therefore, the inflow of the hydraulic fluid remaining in the reduction chamber into the discharge channel is prevented by the remaining fluid inflow prevention pipe and the seal lip. According to the third aspect, the pump apparatus comprises the remaining fluid inflow prevention pipe having one end fitted into and fixed to the discharge channel between the outer surface of the housing and the reduction chamber, and the other end positioned in the reduction chamber; and a seal part for fluid-tightly sealing the space between the inner wall of the discharge channel and the one end of the remaining fluid inflow prevention pipe. Therefore, the inflow of the hydraulic fluid remaining in the reduction chamber into the discharge channel is prevented by the remaining fluid inflow prevention pipe and the seal part. When the pump apparatus is installed in a vehicle and activated, the hydraulic fluid discharged from the pump apparatus fills the reduction chamber, flows into the discharge channel from the other end of the remaining fluid inflow prevention pipe, and is fed out of the opening in the outer surface of the housing. Thus, the remaining fluid inflow prevention pipe and the seal lip or seal part prevent the hydraulic fluid remaining in the reduction chamber from flowing into the discharge channel without interfering with the function of the pump apparatus, thereby preventing various problems associated with the leakage of the hydraulic fluid from the opening in the outer surface of the housing.

According to the second aspect, since the seal lip is formed in a shape tapered toward the discharge side, when a force acts in the direction of pulling out the remaining fluid inflow prevention pipe, a force toward the discharge side acts on the seal lip due to the frictional resistance with the inner wall of the discharge channel, and the seal lip is pushed strongly against the inner wall of the discharge channel. Consequently, the frictional resistance between the inner wall of the discharge channel and the seal lip becomes stronger due to the push, and the remaining fluid inflow prevention pipe is prevented from being pulled out of the discharge channel.

According to the fourth aspect, since the outside diameter of the other end of the remaining fluid inflow prevention pipe is made larger than the inside diameter of the discharge channel between the outer surface of the housing and the reduction chamber, the other end of the remaining fluid inflow prevention pipe cannot be fitted into and fixed to the discharge channel, thereby preventing mistakes in connecting the remaining fluid inflow prevention pipe.

In the pump apparatus of the present invention, since the inflow of the hydraulic fluid remaining in the reduction chamber into the discharge channel is prevented by the remaining fluid inflow prevention pipe and the seal lip or seal part, the hydraulic fluid will not leak out during installation at a shipping destination, and therefore it is possible to prevent various problems associated with the leakage.

Additionally, in the pump apparatus of the present invention, since the remaining fluid inflow prevention pipe is provided, air in the reduction chamber can be exhausted from the remaining fluid inflow prevention pipe to the outside through the discharge channel. Therefore, the effect of a pulsation reduction in the reduction chamber can be stabilized, and the generation of an abnormal noise due to the air remaining in the reduction chamber can be reduced.

The above and further objects and features of the invention will more fully be apparent from the following detailed description with accompanying drawings.

DETAILED DESCRIPTION OF THE INVENTION

The following description will explain in detail the present invention, based on the drawings illustrating some embodiments thereof.

Embodiment 1

Figure 1:
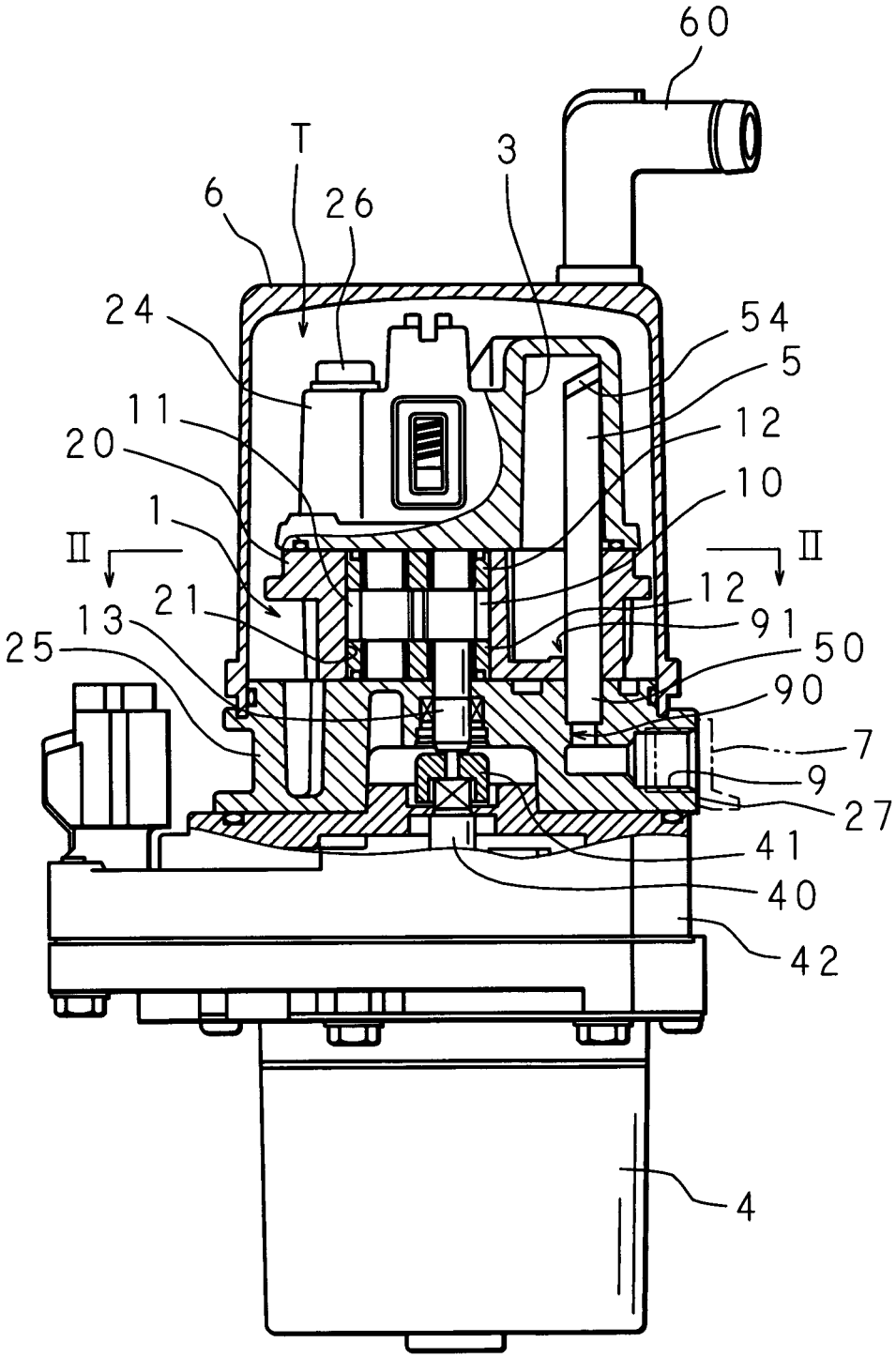
FIG. 1 is a vertical cross sectional view of a pump apparatus of an embodiment.
Figure 2:
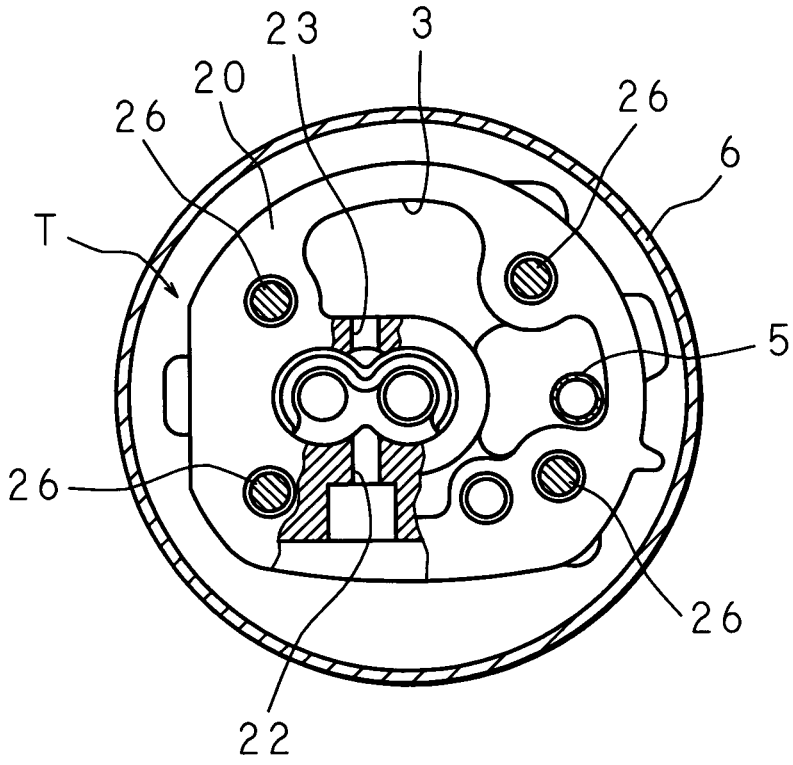
FIG. 2 is a cross sectional view along the II-II line of FIG. 1.

FIG. 1 is a vertical cross sectional view of a pump apparatus of Embodiment 1, and FIG. 2 is a cross sectional view along the II-II line of FIG. 1.

In FIG. 1, numeral 1 is a pump section. The pump section 1 is constructed as a gear pump, and comprises a driving gear 10 and a driven gear 11 that mesh with each other inside a cavity 21 which has an oval cross section and is formed in a gear housing 20. The driving gear 10 and the driven gear 11 are sandwiched between a pair of side plates 12, 12 fitted into the cavity 21, and are supported rotatably at both ends while holding the meshed state. The gear housing 20 is sandwiched between a cover housing 24 and a disk-shaped base housing 25, and the gear housing 20 and the cover housing 24 are fastened and fixed together to one surface of the base housing 25 with a plurality of fixing bolts 26, 26, . . . (only one is shown in FIG. 1).

In the gear housing 20, a suction channel 22 for sucking a hydraulic oil is provided on one side of the meshed section of the driving gear 10 and driven gear 11, and a discharge channel 23 (first discharge channel) for discharging the hydraulic oil is provided on the other side of the meshed section.

The suction channel 22 is connected to a reservoir tank T constructed inside a tank pipe 6 which is in the shape of a cylinder with a base, has an opening-side rim externally fitted and fixed to the outside edge of one surface side of the base housing 25, and covers the gear housing 20 and cover housing 24. The reservoir tank T is constructed so that it can be connected to the outside of the pump section 1 through a return pipe 60 provided on the tank pipe 6.

The discharge channel 23 is connected to a reduction chamber 3 formed in the gear housing 20 and cover housing 24 from the connection surface between the two housings 20 and 24. The reduction chamber 3 is connected to an outlet 9 formed in an outer surface 27 of the base housing 25 through a discharge channel 90 (second discharge channel). A cylindrical remaining fluid inflow prevention pipe 5 made of a synthetic resin is placed inside the reduction chamber 3. One end 50 of the remaining fluid inflow prevention pipe 5 is fitted into and fixed to the discharge channel 90, and the other end 54 thereof is positioned near the inner wall of the reduction chamber 3 opposite to the opening 91 of the discharge channel 90.

A motor 4 for driving the pump section 1 is mounted on the other surface of the base housing 25 with a motor housing 42 therebetween. An output shaft 40 of the motor 4 passes through the motor housing 42 and protrudes toward the base housing 25 side. A pump shaft 13 is attached to the shaft center of the driving gear 10 of the pump section 1. The pump shaft 13 passes through one side plate 12 and the base housing 25, and protrudes toward the motor housing 42 side. The output shaft 40 and the pump shaft 13 are positioned to face each other between the base housing 25 and the motor housing 42, and connected together with a fitting type coupling 41.

The pump apparatus of the present invention constructed as described above supplies the hydraulic oil to the reservoir tank T, and drives the motor 4 to perform a pump operation. The rotation of the output shaft 40 of the motor 4 is transmitted to the pump shaft 13 through the coupling 41, and then the driving gear 10 attached to the pump shaft 13 rotates together with the driven gear 11 that meshes with the driving gear 10 inside the cavity 21 of the gear housing 20. With the rotation of the driving gear 10 and driven gear 11, the pump section 1 keeps the hydraulic oil sucked from the suction channel 22 connected to the reservoir tank T between the teeth of the respective gears 10 and 11 and the inner surface of the cavity 21 of the gear housing 20, and transports and pressurizes the hydraulic oil. The transported and pressurized hydraulic oil is fed from the discharge channel 23 to the reduction chamber 3 where the pulsation components are reduced, fills the reduction chamber 3, and flows into the discharge channel 90 from the other end 54 of the remaining fluid inflow prevention pipe 5. The hydraulic oil flowed into the discharge channel 90 is fed to a oil feed destination (not shown) from the outlet 9, and the return oil from the oil feed destination is circulated into the reservoir tank T through the return pipe 60 of the tank pipe 6.

After assembly, a performance inspection is performed on such a pump apparatus of the present invention by supplying the hydraulic oil from the suction channel 22. After finishing the performance inspection, the hydraulic oil is removed, the reservoir tank T is mounted, a dustproof cap 7 (shown by the alternate long and two short dashes line in FIG. 1) is attached to the outlet 9, and then the pump apparatus is shipped. The shipped pump apparatus is installed in a vehicle at a shipping destination by detaching the dustproof cap 7 from the outlet 9 and connecting the outlet 9 and the return pipe 60 to an oil feed destination of the pressurized oil, such as a power steering apparatus and an automatic transmission apparatus.

In the pump apparatus of the present invention, since the configuration of the path from the pump section 1 to the outlet 9 is complicated, it is difficult to perfectly remove the hydraulic oil used for the performance inspection, and consequently the pump apparatus is sometimes shipped with the hydraulic oil remaining in the reduction chamber 3. In this case, the remaining fluid inflow prevention pipe 5 with the one end 50 fitted into and fixed to the discharge channel 90 prevents the hydraulic oil remaining in the reduction chamber 3 from flowing into the discharge channel 90.

Figure 3:
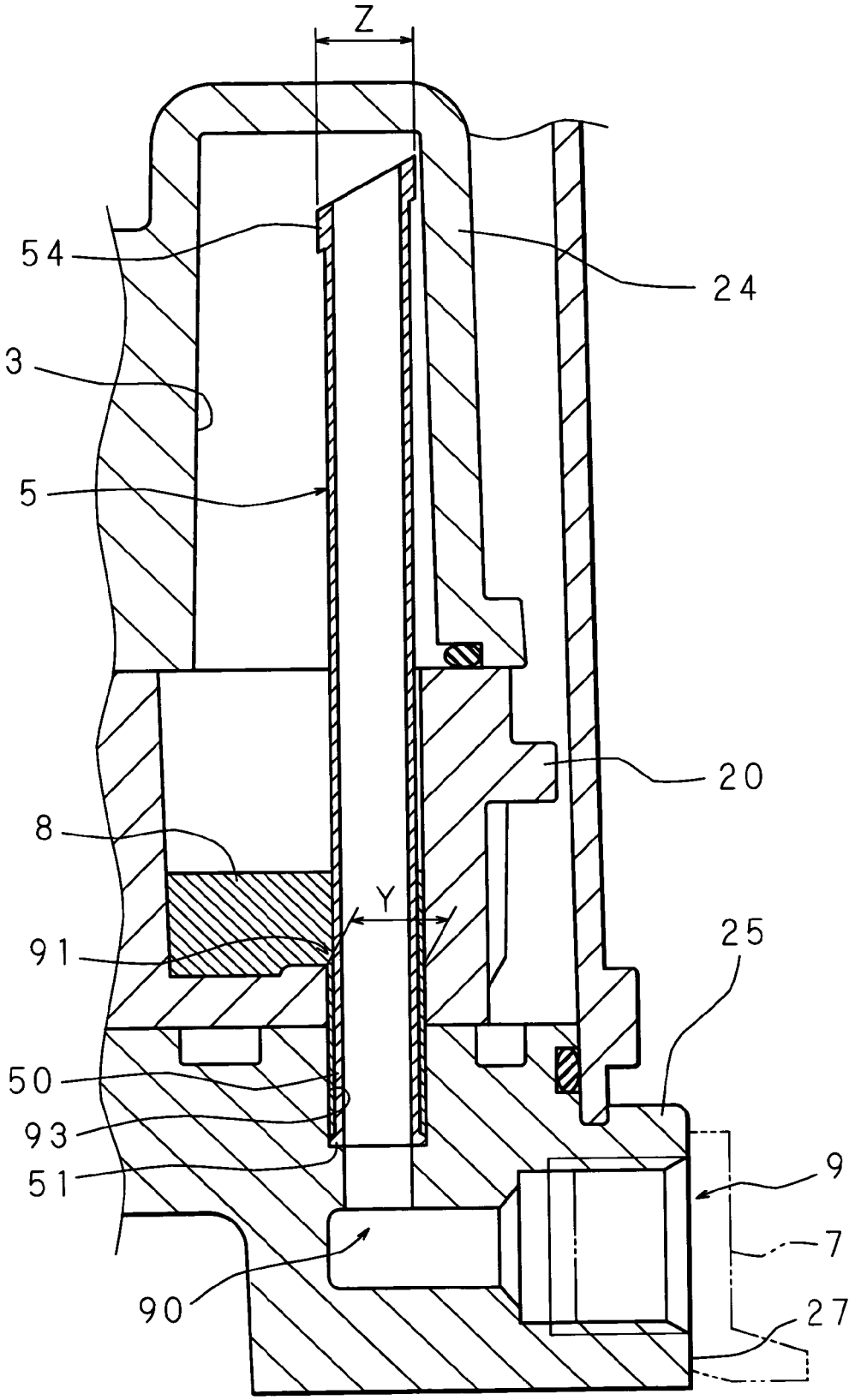
FIG. 3 is an enlarged cross sectional view of the vicinity of a remaining fluid inflow prevention pipe.
Figure 4A:
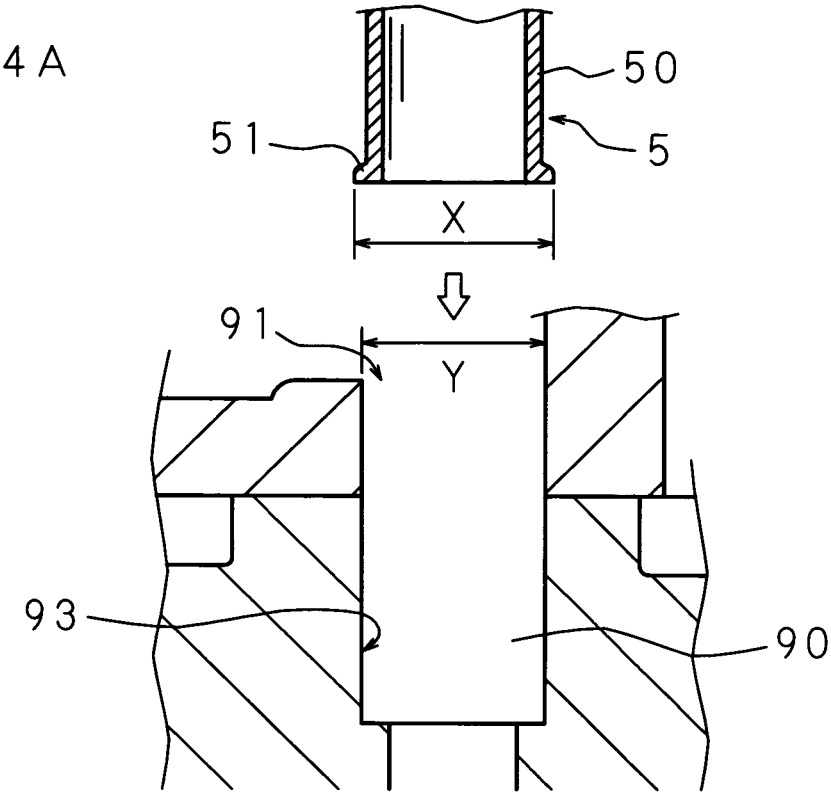
FIGS. 4A and 4B are explanatory views showing the steps of connecting the remaining fluid inflow prevention pipe to a discharge channel.
Figure 4B:
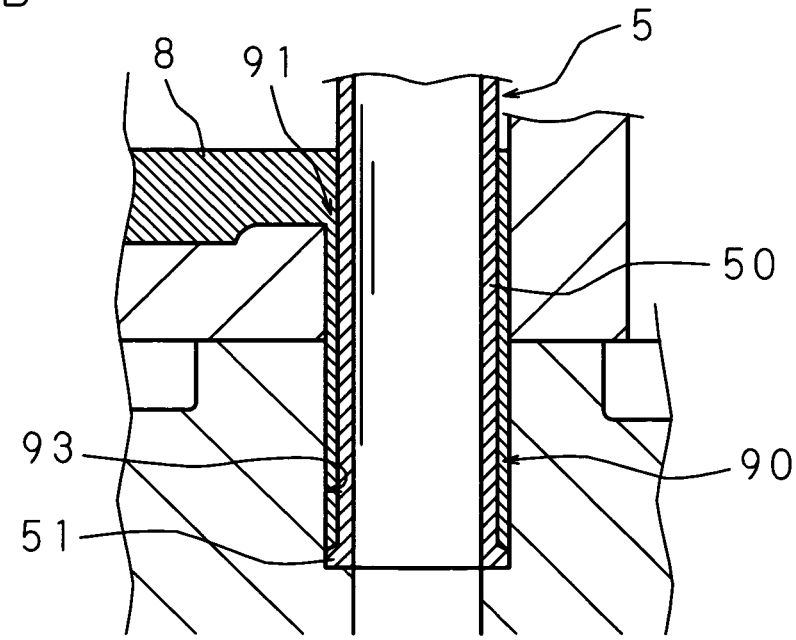

FIG. 3 is an enlarged cross sectional view of the vicinity of the remaining fluid inflow prevention pipe 5, and FIGS. 4A and 4B are explanatory views showing the steps of connecting the remaining fluid inflow prevention pipe 5 to the discharge channel 90.

A seal part 51 is formed on the outer circumference of the one end 50 of the remaining fluid inflow prevention pipe 5. The seal part 51 is a seal lip in the form of a flange and capable of being deformed elastically. The outside diameter X of the seal part 51 is made slightly larger than the inside diameter Y of the discharge channel 90 to such a degree that the one end 50 of the remaining fluid inflow prevention pipe 5 can be fitted into the discharge channel 90 by deforming the seal part 51 elastically.

With this structure, when the one end 50 of the remaining fluid inflow prevention pipe 5 is fitted into the discharge channel 90, the seal part 51 is elastically deformed and pushed against the inner wall 93 of the discharge channel 90, and fluid-tightly seals the space between the inner wall 93 and the one end 50. Therefore, the hydraulic oil 8 remaining in the reduction chamber 3 does not flow into the discharge channel 90 from the space between the one end 50 of the remaining fluid inflow prevention pipe 5 and the inner wall 93 of the discharge channel 90. Moreover, since the other end 54 of the remaining fluid inflow prevention pipe 5 and the oil surface of the hydraulic oil 8 remaining in the reduction chamber 3 are sufficiently separated, the hydraulic oil 8 will not flow into the discharge channel 90 from the other end 54 of the remaining fluid inflow prevention pipe 5. Therefore, even when the pump apparatus of the present invention is shipped in a state in which the hydraulic oil 8 used for the performance inspection remains in the reduction chamber 3, the hydraulic oil 8 does not leak out of the outlet 9 when a worker at the shipping destination detaches the dustproof cap 7 to install the pump apparatus in a vehicle, thereby preventing various problems such as, for example, preventing the periphery from being soiled with the leaked hydraulic oil 8, and preventing the leaked hydraulic oil 8 from dropping onto the floor surface and making the floor slippery for the worker.

Figure 5:
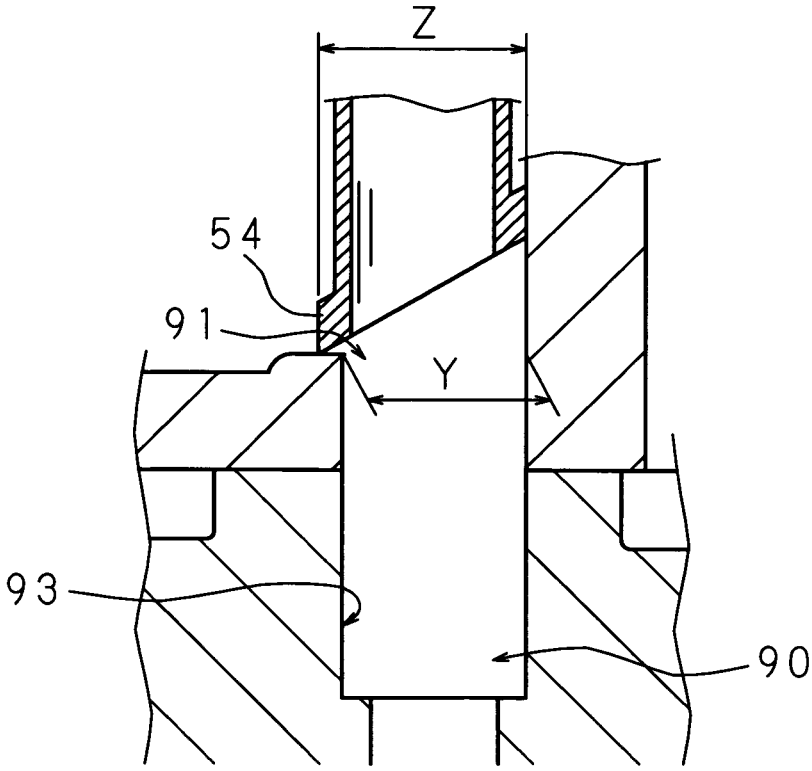
FIG. 5 is an explanatory view showing the difference between the outside diameter of other end of the remaining fluid inflow prevention pipe and the inside diameter of the discharge channel.

On the other hand, the other end 54 of the remaining fluid inflow prevention pipe 5 has a larger diameter than the one end 50, and the outside diameter Z of the other end 54 is made sufficiently larger than the inside diameter Y of the discharge channel 90 so that the other end 54 cannot be fitted into the discharge channel 90. With this structure, since the other end 54 of the remaining fluid inflow prevention pipe 5 cannot be fitted into the discharge channel 90 (see FIG. 5), it is possible to prevent mistakes in connecting the remaining fluid inflow prevention pipe 5.

Embodiment 2

Figure 6A:
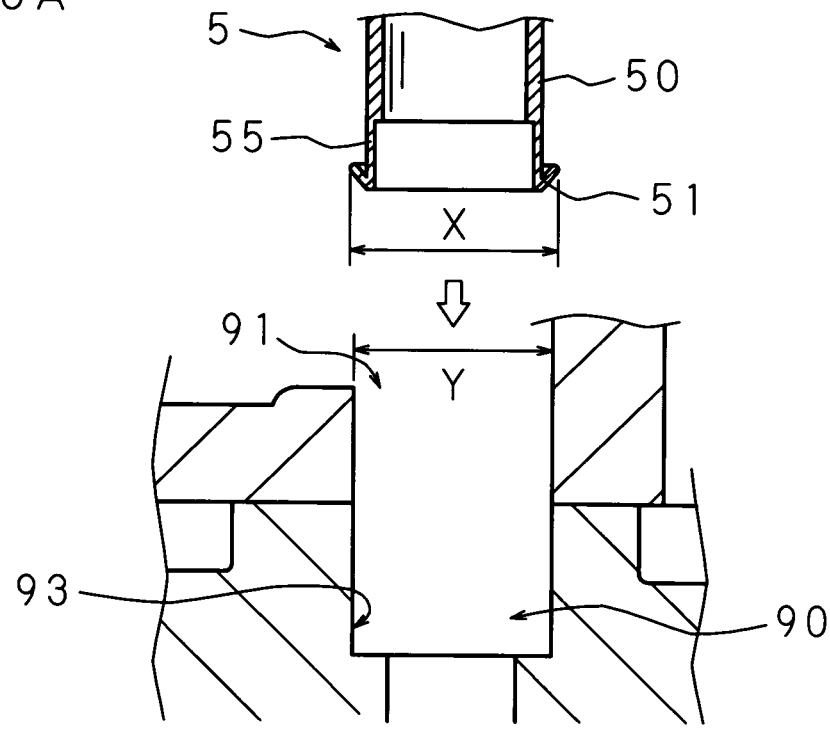
FIGS. 6A and 6B are explanatory views showing the steps of connecting the remaining fluid inflow prevention pipe to a discharge channel.
Figure 6B:
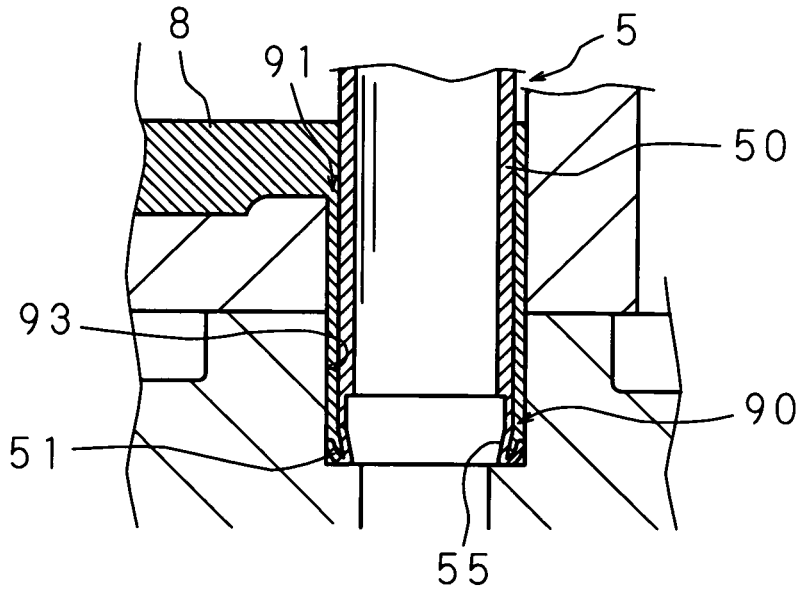

FIGS. 6A and 6B are explanatory views showing the steps of connecting the remaining fluid inflow prevention pipe 5 to the discharge channel 90 of a pump apparatus of Embodiment 2.

In FIGS. 6A and 6B, numeral 5 is a cylindrical remaining fluid inflow prevention pipe made of a synthetic resin, and similarly to Embodiment 1, the one end 50 of the remaining fluid inflow prevention pipe 5 is fitted into and fixed to the discharge channel 90. A seal part 51 is formed on the outer circumference of the one end 50 of the remaining fluid inflow prevention pipe 5. The seal part 51 is a seal lip formed in a shape tapered toward the discharge side, and the outside diameter X of the larger diameter side of the seal part 51 is made slightly larger than the inside diameter Y of the discharge channel 90. Moreover, a thin portion 55 having a larger inside diameter and a smaller thickness than other portion is formed in the one end 50 of the remaining fluid inflow prevention pipe 5.

With this structure, when the one end 50 of the remaining fluid inflow prevention pipe 5 is fitted into the discharge channel 90, the seal part 51 is elastically deformed to a smaller diameter and elastically comes into contact with the inner wall 93 of the discharge channel 90 to seal the space between the inner wall 93 of the discharge channel 90 and the one end 50 of the remaining fluid inflow prevention pipe 5. At this time, the thin portion 55 is also elastically deformed and produces a repulsive force that pushes the seal part 51 against the inner wall 93 of the discharge channel 90 to improve the sealing performance of the seal part 51. Thus, the remaining fluid inflow prevention pipe 5 and the seal part 51 certainly prevent the hydraulic oil 8 remaining in the reduction chamber 3 from flowing into the discharge channel 90. Therefore, even when the pump apparatus of the present invention is shipped in a state in which the hydraulic oil 8 used for the performance inspection remains in the reduction chamber 3, the hydraulic oil 8 will not leak out during installation at the shipping destination, thereby preventing various problems associated with the leakage.

Moreover, when fitting the one end 50 of the remaining fluid inflow prevention pipe 5 into the discharge channel 90, a force acts on the seal part 51 in the opposite direction to the discharge side due to the frictional resistance between the inner wall 93 of the discharge channel 90 and the seal part 51, and the force of pushing the seal part 51 against the inner wall 93 of the discharge channel 90 becomes weaker. Consequently, the frictional resistance between the inner wall 93 of the discharge channel 90 and the seal part 51 becomes weaker, and the one end 50 of the remaining fluid inflow prevention pipe 5 is easily fitted into the discharge channel 90.

Further, when a force acts in the direction of pulling out the remaining fluid inflow prevention pipe 5, a force toward the discharge side acts on the seal part 51 due to the frictional resistance between the inner wall 93 of the discharge channel 90 and the seal part 51, and the larger diameter side of the seal part 51 is pushed strongly against the inner wall 93 of the discharge channel 90. Consequently, the frictional resistance between the inner wall 93 of the discharge channel 90 and the seal part 51 becomes stronger, and prevents the remaining fluid inflow prevention pipe 5 from being pulled out of the discharge channel 90.

The pump apparatus according to the present invention has been explained above based on the drawings illustrating Embodiment 1 or 2, but the pump apparatus of the present invention is not limited to the structures illustrated in Embodiment 1 or 2 above, and part of the structures may be added, deleted, or modified within the scope of the present invention.

Figure 7A:
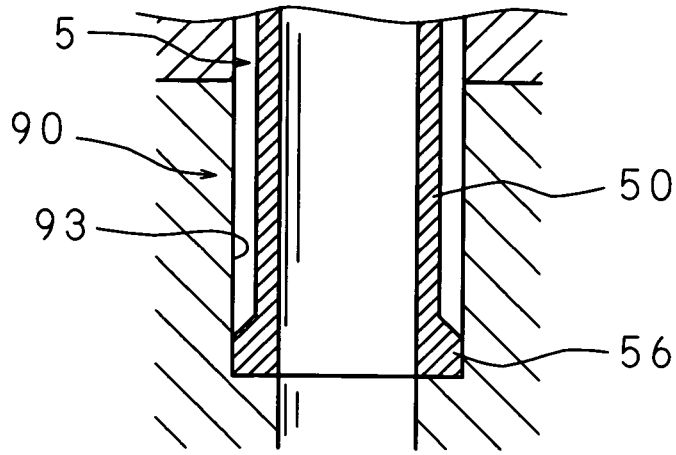
FIGS. 7A, 7B and 7C are vertical cross sectional views of one end of the remaining fluid inflow prevention pipe according to another embodiment.
Figure 7B:
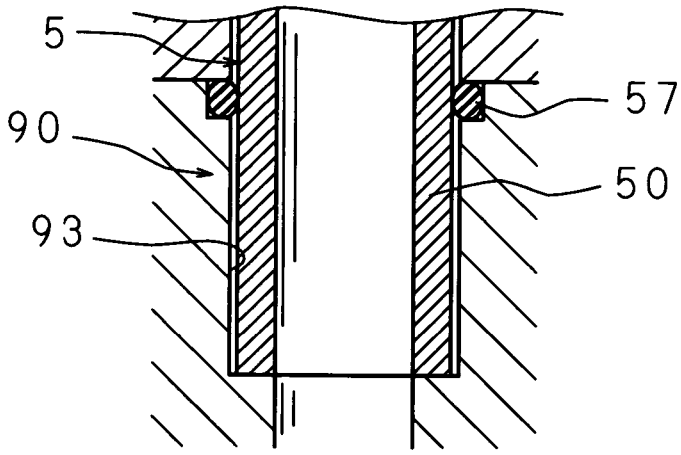
Figure 7C:
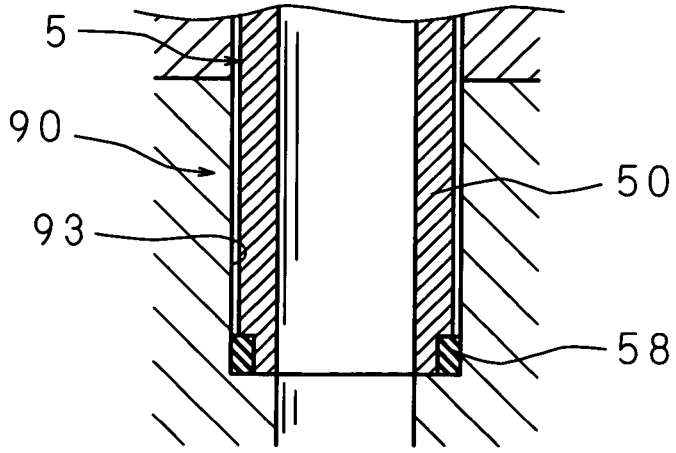

For example, as shown in FIG. 7A, the one end 50 of the remaining fluid inflow prevention pipe 5 may comprise a seal part 56 with a larger diameter only in a predetermined distance from the end face along the axial direction. Alternatively, as shown in FIG. 7B, an O ring interposed between the one end 50 of the remaining fluid inflow prevention pipe 5 and the inner wall 93 of the discharge channel 90 may be constructed as a seal part 57. Further, as shown in FIG. 7C, it may be possible to construct a seal part 58 by integrally forming an elastic material such as a synthetic resin or a natural rubber with the one end 50 of the remaining fluid inflow prevention pipe 5.

Additionally, in Embodiment 1 or 2 as described above, although the material of the remaining fluid inflow prevention pipe 5 is a synthetic resin, it is not limited to a synthetic resin, and may be, for example a synthetic rubber or a natural rubber.

Moreover, in Embodiment 1 or 2 described above, since the whole remaining fluid inflow prevention pipe 5 is formed of a synthetic resin, the whole remaining fluid inflow prevention pipe 5 has elasticity. However, the whole remaining fluid inflow prevention pipe 5 does not necessarily have elasticity as long as the seal part 51 has elasticity.

Further, although Embodiment 1 or 2 described above explains the application of the present invention as a pump apparatus that is installed in a vehicle to obtain the hydraulic oil pressure of an assistant apparatus such as a power steering apparatus and an automatic transmission apparatus, the present invention is applicable to a pump apparatus for use in other applications, and is also applicable to a pump apparatus using a liquid other than oil as a hydraulic fluid. Besides, the pump section 1 is not limited to the gear pump explained in Embodiment 1 or 2 above, and may be other type of pump such as a vane pump. In addition, the driving source of the pump section 1 is not limited to the motor 4.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A pump apparatus, comprising:

a housing;

a pump section and a reduction chamber within the housing;

a first discharge channel within the housing, the pump section connected to the reduction chamber by the first discharge channel so that hydraulic fluid pressurized in the pump section is supplied to the reduction chamber;

a second discharge channel within the housing, the reduction chamber connected to an outlet provided in an outer surface of the housing by the second discharge channel; and a remaining fluid inflow prevention pipe disposed vertically within the housing and having a first and second end, the first end disposed in the reduction chamber, the second end fitted into the second discharge channel, wherein the second end has an integrally formed seal end part having an outer diameter larger than an inner diameter of the second discharge channel, the seal end part elastically deformed to form a seal while maintaining the inner diameter of the second discharge channel when installed within the second discharge channel, the seal end part having a first end and a second end at the second end of the remaining fluid inflow prevention pipe, wherein the second end of the seal end part is closer to the remaining fluid inflow prevention pipe second end than the first end of the seal end part in an axial direction of the inflow prevention pipe, the seal end part second end having a greater diameter than the seal end part first end;

said remaining fluid inflow prevention pipe is configured to prevent hydraulic oil remaining in the reduction chamber from flowing into the outlet provided in an outer surface of the housing from a space between the outer diameter of the second end and an inner wall of the second discharge channel, and wherein the remaining fluid inflow prevention pipe is made of a synthetic resin, wherein the second discharge channel has a stepped portion, and the stepped portion of the second discharge channel contacts two faces of the seal end part, for sealing, and wherein the second end of the remaining fluid inflow prevention pipe has a thin portion with a larger inside diameter and a smaller thickness than another portion over a predetermined length.

2. The pump apparatus according to claim 1, wherein the seal end part is in a form of a flange.

3. The pump apparatus of claim 1, wherein the first end of the remaining fluid inflow prevention pipe is disposed higher than the second end of the remaining fluid inflow prevention pipe.

4. The pump apparatus according to claim 1, wherein the first end of the remaining fluid inflow prevention pipe has an outer diameter larger than the outer diameter of the seal end part and the inner diameter of the second discharge channel.

5. A pump apparatus, comprising:

a housing;

a pump section and a reduction chamber within the housing;

a first discharge channel within the housing, the pump section connected to the reduction chamber by the first discharge channel so that hydraulic fluid pressurized in the pump section is supplied to the reduction chamber;

a second discharge channel within the housing, the reduction chamber connected to an outlet provided in an outer surface of the housing by the second discharge channel; and a remaining fluid inflow prevention pipe disposed vertically within the housing and having a first and second end, the first end disposed in the reduction chamber, the second end fitted into the second discharge channel, wherein the second end has an integrally formed seal end part having an outer diameter larger than an inner diameter of the second discharge channel, the seal end part elastically deformed to form a seal while maintaining the inner diameter of the second discharge channel when installed within the second discharge channel, the seal end part having a first end and a second end at the second end of the remaining fluid inflow prevention pipe, wherein the second end of the seal end part is closer to the remaining fluid inflow prevention pipe second end than the first end of the seal end part in an axial direction of the inflow prevention pipe, the seal end part second end having a smaller diameter than the seal end part first end;

said remaining fluid inflow prevention pipe is configured to prevent hydraulic oil remaining in the reduction chamber from flowing into the outlet provided in an outer surface of the housing from a space between the outer diameter of the second end and an inner wall of the second discharge channel, and wherein the remaining fluid inflow prevention pipe is made of synthetic resin, and wherein the second discharge channel has a stepped portion, and the stepped portion of the second discharge channel contacts two faces of the seal end part, for sealing, and wherein the second end of the remaining fluid inflow prevention pipe has a thin portion with a larger inside diameter and a smaller thickness than another portion over a predetermined length.

6. The pump apparatus according to claim 5, wherein the first end of the remaining fluid inflow prevention pipe has an outer diameter larger than the outer diameter of the seal end part and the inner diameter of the second discharge channel.

* * * * *